US006189628B1

(12) United States Patent
Jenne

(10) Patent No.: US 6,189,628 B1
(45) Date of Patent: Feb. 20, 2001

(54) EARTH BORER SYSTEM WITH DRILL-ROD CHANGER

(75) Inventor: Dietmar Jenne, Strengelbach (CH)

(73) Assignee: Terra AG fuer Tiefbautechnik, Strengelbach (CH)

( * ) Notice: Under 35 U.S.C. 154(b), the term of this patent shall be extended for 0 days.

(21) Appl. No.: 09/298,754

(22) Filed: Apr. 23, 1999

(30) Foreign Application Priority Data

Jan. 13, 1999 (DE) ..... 199 01 001

(51) Int. Cl.[7] ..... E21B 19/00

(52) U.S. Cl. ..... 175/52; 175/85; 175/122; 414/22.51

(58) Field of Search ..... 175/52, 85, 89, 175/113, 122, 162, 195, 203, 256; 414/22.51

(56) References Cited

U.S. PATENT DOCUMENTS

Re. 30,071 * 8/1979 Hilding et al. ..... 175/52
4,296,820 * 10/1981 Loftis ..... 175/52
4,547,109 * 10/1985 Young et al. ..... 175/85 X

* cited by examiner

*Primary Examiner*—Roger Schoeppel
(74) *Attorney, Agent, or Firm*—McCormick, Paulding & Huber LLP

(57) ABSTRACT

This invention relates to an earth borer system with a frame (48) incorporating a moveable rotary drive (50, 54) for a drill rod assembly consisting of at least two drill rods which can be detachably connected with one another along a bore axis (58); with a drill rod magazine (44) attached to the frame (48); with a release mechanism positioned on the frame provided with a clamping unit (102, 104, 106, 108, 110) that engages in a first drill rod and a breakaway unit that engages in one section of the rotary drive (50, 54) or in a second drill rod; and with at least one transport arm (66) that is attached to the frame and which can move a drill rod released from the drill rod assembly into a standby position in the drill rod magazine (44) or retrieve a drill rod from its standby position and place it on the drill rod assembly. According to this invention, at least one component unit of the release mechanism is mounted on the transport arm (66).

15 Claims, 5 Drawing Sheets

EARTH BORER SYSTEM WITH DRILL-ROD CHANGER

FIELD OF THE INVENTION

This invention relates to an earth borer system with a frame incorporating a movable rotary drive for a drill rod assembly consisting of at least two drill rods which can be detachably connected with one another, with a drill rod magazine mounted on the frame, with a release mechanism located on the frame which is provided with a clamping unit that engages in a first drill rod and a break-away unit that engages in one section of the said rotary drive or in a second drill rod, and with at least one transport arm attached to the frame which can move a drill rod released from the drill rod assembly into a standby position in the drill-rod magazine or take a drill rod from its standby position and position it on the drill rod assembly.

BACKGROUND OF THE INVENTION

An earth borer system of this type has been described earlier for instance in the publication EP-A-0 819 820. It includes drill rods which can be screwed together to extend the overall drill rod assembly. For drilling a bore hole, an additional drill rod is moved out of the magazine with the aid of the transport arm, attached to the drill rod assembly, screwed at one end to the rotary drive which for that purpose is retracted into a rearward home position, and screwed with its other end to the back end of the drill rod assembly. In analogous fashion, when upon completion of the drilling operation the drill rod assembly is withdrawn, the drill rods are unscrewed from the rear and the transport arm then moves them back into the magazine.

During the drilling process, the threaded junctions at the rotary drive and between the drill rods usually tend to be tightened beyond the original torque due to the considerable resistance of the subsoil to the mechanical rotation of the drill rod assembly. If both the effective drive torque and the resistance offered by the subsoil are greater than the static friction resistance between the contact surfaces of two drill rods, the threaded connection between these drill rods is tightened further. In the process, the drill rods are turned against the sliding friction resistance of their contact surfaces and are more strongly pressed together in an axial direction.

Given that the static friction resistance is greater than the sliding friction resistance, the torque required to unscrew the rods must be even higher than the torque with which the threaded rod connections are tightened during the drilling operation.

In order to have enough torque for unscrewing the drill rods with a resistive strength greater than the static friction, current systems employ a breakaway unit. In the system disclosed in EP-A-0 819820, a clamping unit is provided at the forward end of the frame, with a breakaway unit mounted immediately behind it.

If, for example, the drill rod assembly is to be extended by the addition of a drill rod, the first step is to stop the rotary drive in a forward retaining position on the frame. Then two hydraulically operated clamping jaws of the clamping unit are pressed against the back end of the rearward drill rod while similar clamping jaws on the breakaway unit grasp a drive chuck on the rotary drive. The clamping jaws of the breakaway unit are attached to a casing which by means of a hydraulic cylinder can be swiveled around the drill axis. For loosening the screw connection the hydraulic cylinder, turning the casing, applies a high torque on the drive chuck in a rotational direction opposite that selected for the drilling operation. This overcomes the static friction on the contact surfaces of the drive chuck and the rearmost drill rod and turns both elements by a certain angle in relation to each other.

The clamping jaws of the breakaway unit are then released and the rotary drive continues to turn the drive chuck with a relatively minor torque, thus completely unscrewing the threaded coupling. The rotary drive subsequently moves away from the forward direction into a rearward home position on the frame and, aided by two transport arms, inserts another drill rod.

The transport arms are multi-articulated gripping arms provided at their respective forward end with a hydraulically operated, more or less crescent-shaped grapple and a counter block. Actuating the hydraulic system allows the grapple to open up and, on grasping a drill rod, to close again. As the drill rod is moved between the rod magazine and the drill rod assembly, it is held between the inner surface of the grapple and the counter block.

A drawback of this prior-art design lies in the fact that the breakaway unit takes up much space so that an earth borer system of this type is unsuitable for drilling sites where there is not much room for accommodating the frame. Moreover, the design and operation of the transport arm in these earlier systems are rather complex and thus prone to breakdowns.

SUMMARY OF THE INVENTION

The object of this invention is a structurally uncomplicated, space-saving earth borer system incorporating a release mechanism.

This is accomplished for an earth borer system of the type referred to above by mounting at least one component assembly of the release mechanism on the transport arm.

In the earth borer system according to this invention, either the clamping unit or the breakaway unit of the release mechanism is mounted on the transport arm. This obviates the need for a separate retaining structure for the concerned components of the unit concerned on the frame of the earth borer system which latter, based on this invention, can now be built with shorter dimensions and can be deployed even under limited space conditions.

According to this invention, the clamping or breakaway unit mounted on the transport arm serves at least two purposes for which in conventional systems two different assemblies are needed. For one, it holds a drill rod while that rod is moved back and forth between the magazine and the drill rod assembly. For another, it permits grasping a drill rod screwed to the drill rod assembly, or the drive chuck of the rotary drive, with enough holding strength that during the breakaway, i.e. unscrewing, process it is not possible for the drill rod or, respectively, the drive chuck to turn while being clamped. If the breakaway unit is integrated into the transport arm, it serves a third purpose by providing the swivel action of this unit around the axis of the drill rod assembly. In other words, this invention combines the essentially conventional functions of multiple assemblies in one single assembly, which considerably simplifies the design of the earth borer system.

Another advantage of the earth borer system according to this invention is the fact that on completion of a drilling operation the drill rod assembly can be dismantled very quickly. After the respective rearward drill rod has been unscrewed, the transport arm will without further movement be in the right position for promptly returning the drill rod to the magazine. This saves the time needed after the breakaway in a conventional system for moving the transport arm to, and engaging, the rearward drill rod.

In a preferred and particularly simple embodiment of the earth borer according to this invention, it is the clamping unit that is attached to the transport arm. The clamping unit has fewer components than the breakaway unit and is thus especially easy to integrate in the transport arm.

It is equally possible, however, to mount the breakaway unit on the transport arm. Integrating the breakaway unit is more complex than attaching the clamping unit since for swiveling the unit around the axis of the drill rod assembly in traditional fashion it is necessary to provide a corresponding bearing and a drive mechanism. However, the advantage of that design variant is that even the more complex and bulky mounting structure for the breakaway unit is now no longer needed on the frame, resulting in particularly significant space savings.

As an especially desirable design feature, the transport arm is bearing-mounted on a pivot extending underneath the drill-rod magazine parallel to the drill axis and connected to a drive mechanism, with the clamping or breakaway unit attached to one end of the transport arm. This implementation of the transport arm requires only a simple swivel movement for transporting a drill rod back and forth between the magazine and the drill rod assembly. In other words, it is not necessary to equip the transport arm with complex articulation for which corresponding, individual drive mechanisms would be needed. A simpler design of the transport arm also makes it substantially less susceptible to technical problems. The pivoting mechanism is particularly simple, dependable and quick to operate which saves considerable time in the disassembly and reassembly of the drill rod system.

A transport arm, extending essentially perpendicular to the pivot axis and designed as a disk in the form of the segment of an ellipse the curved side of which points away from the pivot axis, offers an optimum in terms of stability and drive power required for swiveling the transport arm. This is due to the fact that the stated shape of the transport arm is sufficiently large in area and ruggedness to support the clamping or breakaway unit while at the same time the inertia of the transport arm relative to its pivot, and thus the amount of energy needed for the swivel motion, is relatively minor.

In an enhanced design version the transport arm, configured as stated, incorporates a clamping unit with two clamping jaws at least one of which is movable in relation to the other. The movable clamping jaw is preferably rotatable around a spindle on the transport arm and is powered in its swiveling motion by a hydraulic drive which as well is mounted on the transport arm. This design permits simple implementation of the action of gripping a drill rod for transfer and clamping a drill rod for unscrewing a connection. The hydraulic drive for the swivel movement of the clamping jaw can be so dimensioned as to transmit to the drill rod the necessary amount of power. Less power is needed for holding the drill rod while it is being transferred, whereas a very high power level can be selected for clamping the drill rod.

In another embodiment, the clamping unit is provided with elements for creating a positive, matching fit with the respective drill rods. Such positive match allows for a particularly high torque to be transferred from the breakaway unit via the drill rod to the clamping jaws without the drill rod being turned relative to the clamping jaws when a connection is unscrewed.

Employing interchangeable clamping inserts for the clamping jaws permits an easy conversion of the earth borer system for operation with different types of drill rods. It also permits a fairly effortless replacement of worn clamping inserts even during operation of the drilling system.

The clamping inserts will offer a particularly long and effective service life when made of hardened steel and provided with a rough surface finish. Surface roughness increases the static friction resistance of the clamping inserts, so that for breaking a screwed connection a higher torque can be transmitted to the drill rod.

BRIEF DESCRIPTION OF THE DRAWINGS

Other features and advantages of this invention will be evident from the description of a design example with the aid of the drawings in which -

DETAILED DESCRIPTION OF THE PREFERRED EMBODIMENT

Figure 1:
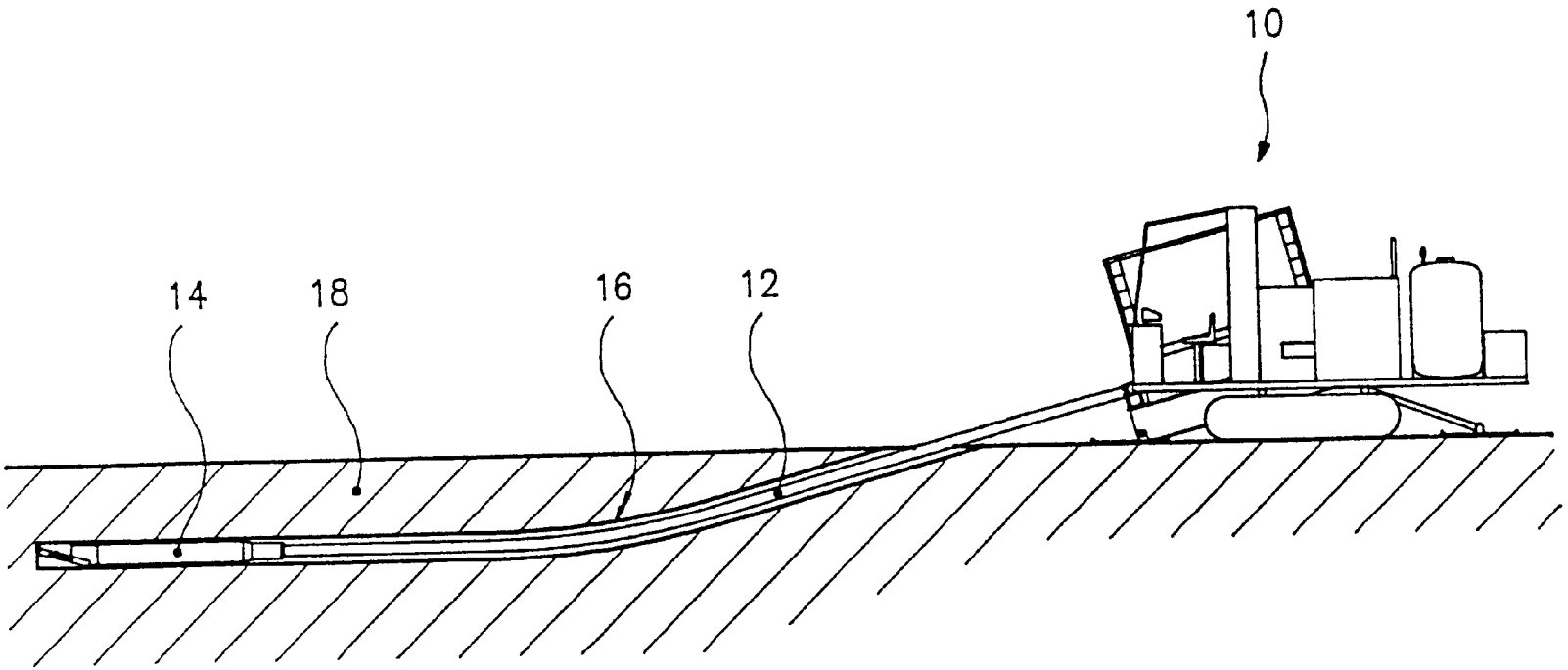
FIG. 1 is a schematic overall view of the earth borer system according to this invention.

Shown in FIG. 1 is an earth borer system 10 according to this invention, from which a drill rod 12 with a guided drill head 14 at its tip extends into a borehole 16. The subsoil 18 in FIG. 1 is shown in cross section to illustrate the curvature of the borehole.

Figure 2:
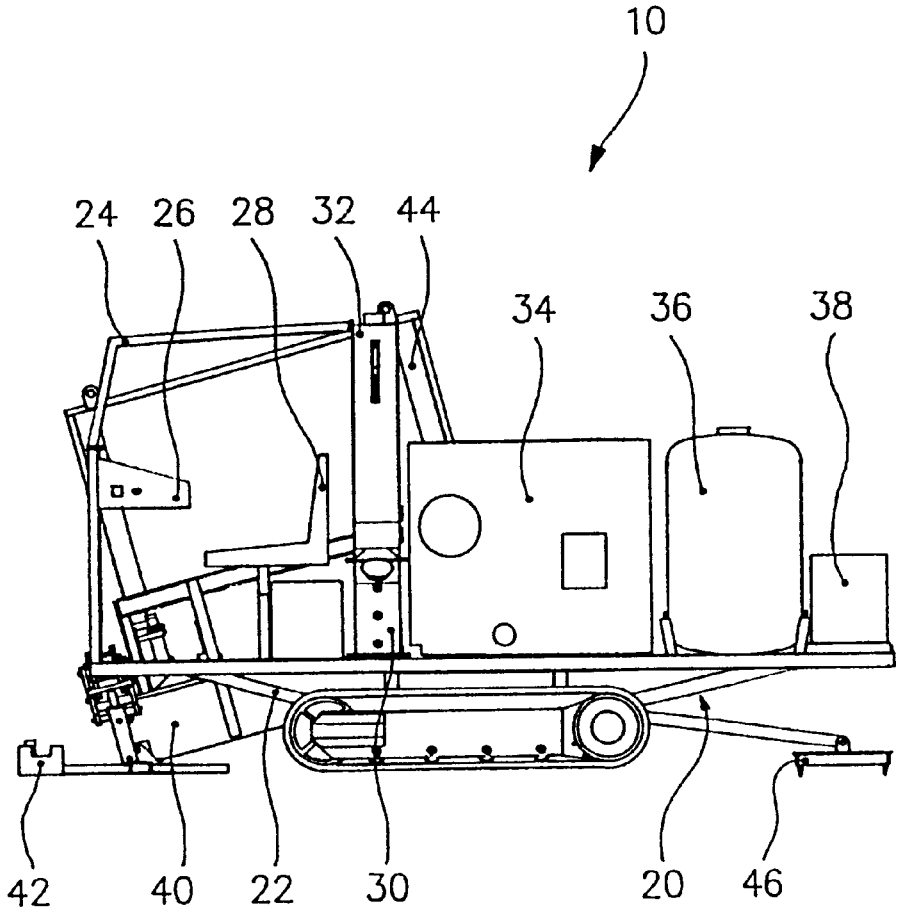
FIG. 2 is an enlarged lateral view of the earth borer system per FIG. 1.

FIG. 2 is a lateral view of a crawler-mounted earth borer system 10 whose chassis 20 is provided with a support frame 22 carrying the superstructures described below. At the forward end of the vehicle a cab 24 contains a control panel 26 and a seat 28. Located behind the seat 26 and forming the rear wall of the cab 24 are a fuel tank 30 and a hydraulic oil tank 32. Behind the rear wall of the cab is a diesel engine 34 with hydraulic system components. Farther back are a drilling fluid tank 36 and a mixing station 38 for the drilling fluid.

Attached on the far side of the earth borer system 10 and sloping toward the ground is a drilling ramp 40, the bottom edge of its forward end resting on a support 42 which may be anchored in the ground. Connected to the top side of the drilling ramp 40 is a drill rod magazine 44.

In the aft section of the earth borer system 10, a support 46 attached to the chassis 20 can be lowered to the ground. This support 46 helps to prevent undesirable jolting of the earth borer system 10 whenever during the drilling operation the resistance of the subsoil to the advance of the drill head 14 impacts the earth borer system 10 by way of the drill rod assembly 12.

Figure 3:
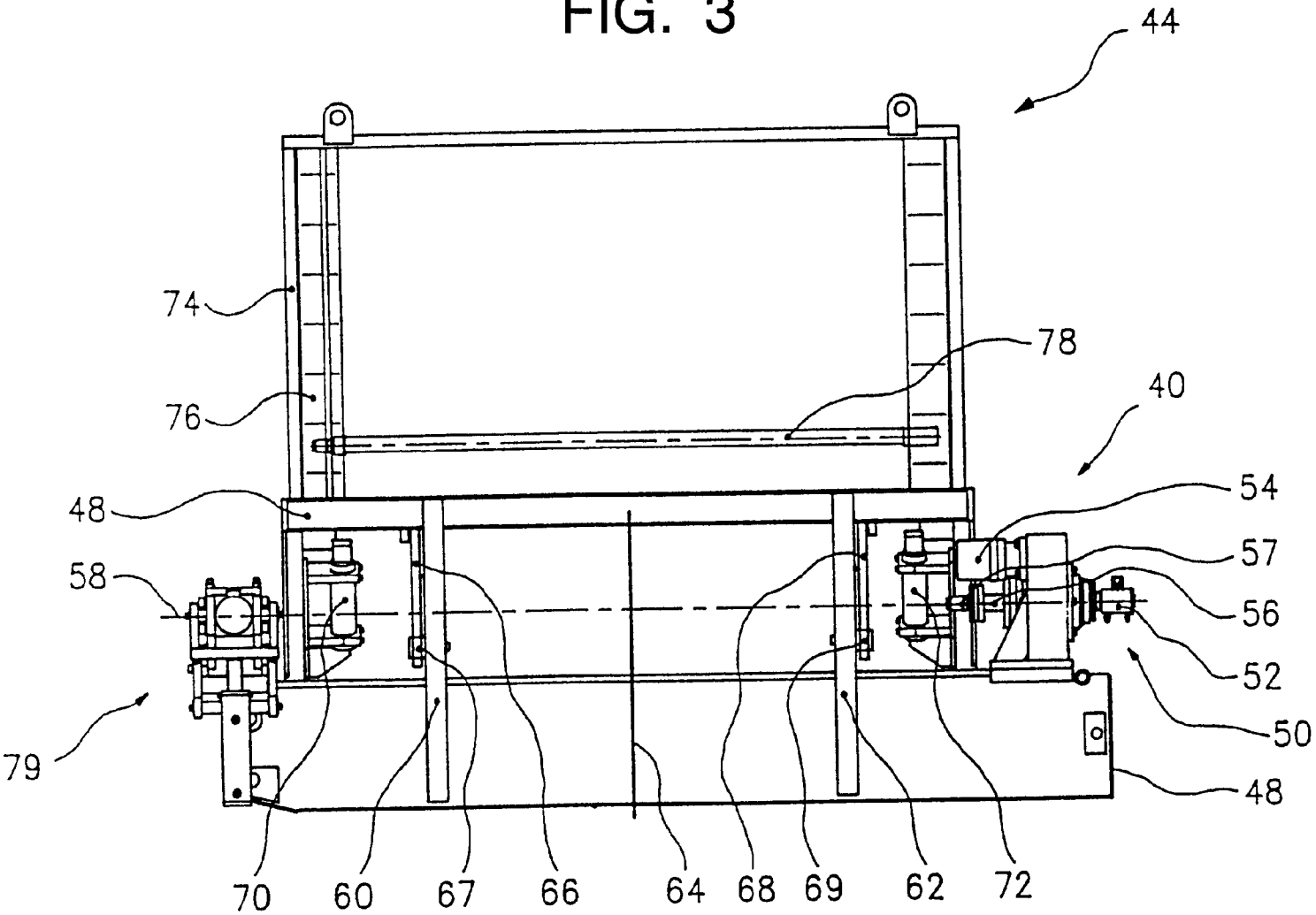
FIG. 3 is a lateral view of a drilling ramp of the earth borer system with a drill rod magazine.

FIG. 3 is a simplified lateral view of the drilling ramp 40 whose various functional elements are mounted on a frame 48. A drive slide 50, which can be moved back and forth along the frame 48 with the aid of a drive mechanism, not illustrated, is shown in this figure in its rearmost stop position. The back end of the drive slide has a fitting 52 for the drilling fluid. Mounted on the front end of the drive slide 50 is a rotary drive motor 54 which rotates a drill rod receptacle with a drive chuck 57.

In the illustration per FIG. 3 the drill rod receptacle 56 is empty. A dotted straight line 58 indicates the position of the bore axis, that is the axis of a drill rod attached to the drive chuck 57 when the earth borer system 10 is in operation.

Two vertical posts 60 and 62 are mounted on the frame 48 of the drilling ramp 40 near the forward and rearward ends of the latter at approximately the same distance from an imagined, vertical central axis 64 of the drilling ramp 40. Transport arms 66 and 68 are mounted on the support posts 60 and 62 for pivotal movement about axes 67 and 69, respectively. Following below is a description of the transport arms with reference to FIG. 4.

Mounted at the front end of the frame 48 is a breakaway unit 79, described in more detail with reference to FIGS. 4 and 5.

Also mounted on the frame, as seen in FIG. 3, at approximately the same distance from the central axis 64 are a front and a rear ejector cylinder 70 and 72 which serve to push a drill rod held by the transport arms 66 and 68 back into the drill rod magazine 44 which connects to the top side of the frame 48 of the drilling ramp 40.

The drill rod magazine 44 extends over essentially the length of a drill rod between the forward and the rearward end of the frame 48. The drill rod magazine proper contains a frame 74 that is open toward the top and bottom and incorporates vertically movable retaining elements 76 which in their vertical position are paired at the front and back end of the drill rod magazine 44. Each pair of retaining elements 76 can accept one drill rod 78. By means of a conventional drive system, not illustrated, all retaining elements 76 can be jointly moved up and down.

Figure 4:
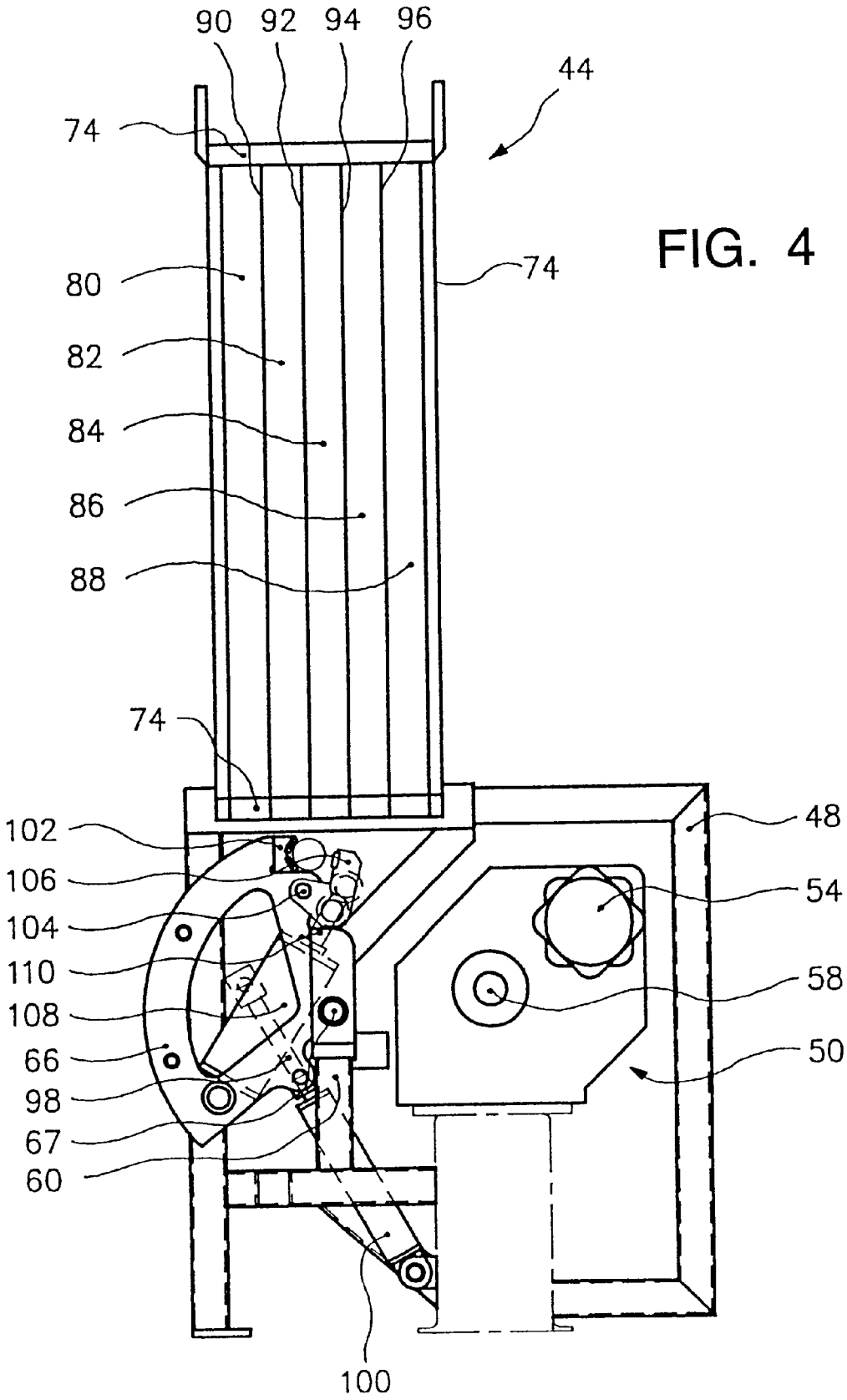
FIG. 4 is a frontal view of the drilling ramp with the drill rod magazine.

As indicated in the simplified frontal view of the earth borer system 10 in FIG. 4, the drill rod magazine 44 contains five vertical compartments 80 to 88 for accepting the drill rods. These compartments are mutually separated by four walls 90 to 96 which are attached to upper and lower sections of the frame 74. It is also possible to use one single drill-rod compartment which would extend in a more or less S-shaped configuration between the upper and the lower end of the drill rod magazine 44.

The forward transport arm 66 is contoured roughly like a section of an ellipse with two intersecting, essentially straight sides and one curved side. The swivel axis 67 is positioned near the point of intersection of the two straight sides. To drive the swivel motion, a piston 98 of a hydraulic cylinder 100 positioned at a distance from the swivel axis bears on the transport arm 66. Both the end of the piston contacting the transport arm and the back end of the cylinder 100 attached to the frame are swivel-mounted. This allows for a changing swivel position of the transport arm 66 as the piston 98 is extended or retracted.

In the swivel position of the transport arm 66 illustrated in FIG. 4, a first clamping jaw 102 integrated into the transport arm 66 and a second clamping jaw 106 which swivels around a pivot 104, face the drill rod magazine. The pivot 104 extends perpendicular to the plane of the transport arm. The inside faces of both clamping jaws are contoured in a way that between them they can grasp and make positive contact with a drill rod. For example, they may have surface sections juxtaposed at consecutive obtuse angles as described in more detail for a clamping jaw 126 of the breakaway unit 79 (ref. FIG. 5). At the point where the clamping jaws 102 and 106 make contact, the surface of the drill rods or the drive chuck 57 is configured to match the shape of the jaws so that positive contact is made in the clamping process. With the aid of a hydraulic clamping cylinder 108, the second clamping jaw 106 can be swiveled toward or away from the first clamping jaw 102. For that purpose, the back end of the clamping cylinder 108 is swivel-mounted on the transport arm while the front end of its piston 110 is swivel-mounted on the second clamping jaw 106. The piston 110, positioned at a distance from the pivot 104, bears on the second clamping jaw 106. When a threaded coupling is to be unscrewed by operating the breakaway unit 79, the clamping cylinder 108 can apply enough pressure to prevent any rotation of a drill rod held between the clamping jaws 102 and 106.

The second transport arm 68 is similar to the first one but has no clamping unit.

Figure 5:
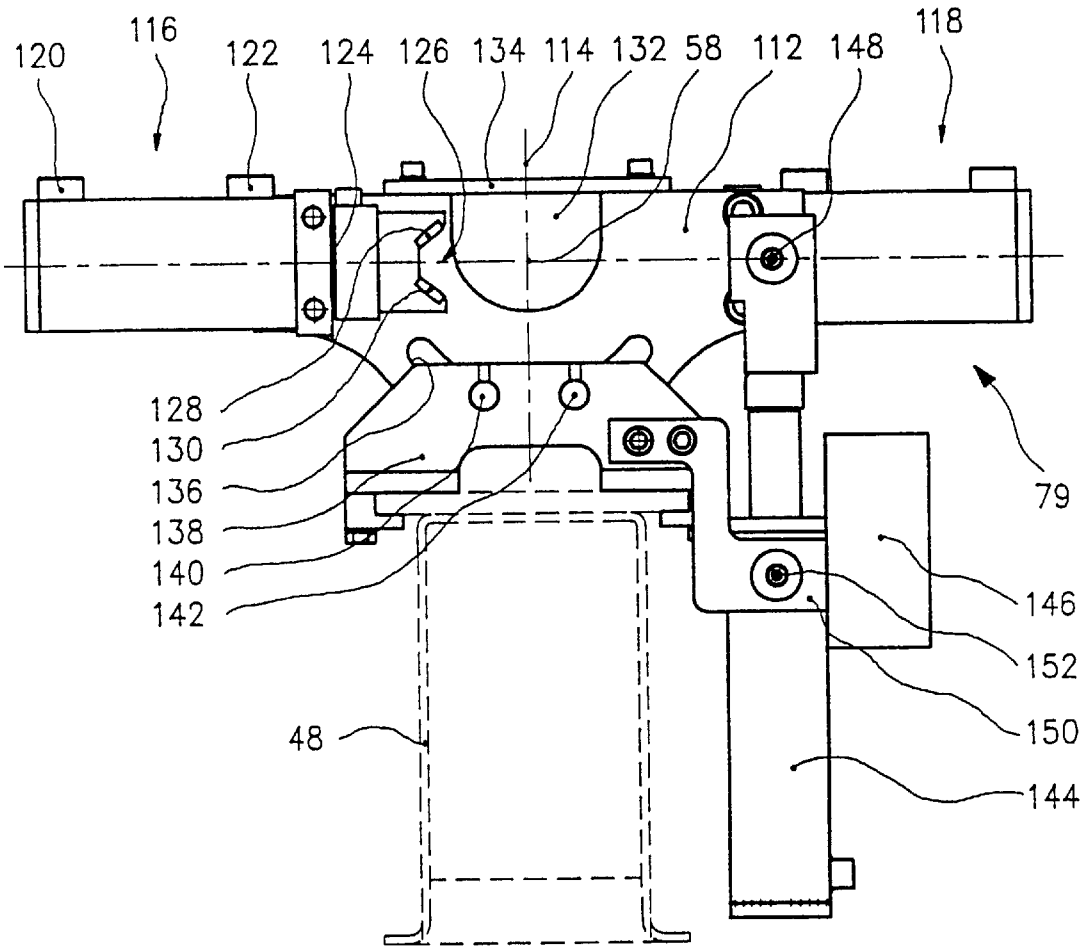
FIG. 5 is a frontal view of a breakaway unit of the earth borer system.

FIG. 5 is a front view of the breakaway unit 79 mounted at the front end of the frame 48 of the drilling ramp 40. The breakaway unit 79 incorporates a support 112 which can rotate around the axis 58 and which has two wings that extend on both sides of, and perpendicular to, an imaginary vertical central plane 114 encompassing the axis 58. Attached to each wing of the support 112 is a clamping cylinder. As seen from the front, the forward end of the left-hand wing supports a first hydraulic clamping cylinder 116 while the rearward end of the right-hand wing supports a second, identical clamping cylinder 118.

The first clamping cylinder 116 is provided with ports 120 and 122 serving as inlets and outlets for a hydraulic fluid by means of which a piston 124 can be extended in the direction of the axis 58 for clamping a drill rod or retracted so as to release the drill rod. Attached to the forward end of the piston 124 is a clamping jaw 126 whose inner surface, pointing toward the axis 58, features juxtaposed linear sections. The center section extends at an obtuse angle of about 120° relative to the two outer sections. The two outer sections are equipped with detachable clamping inserts 128 and 130 made of hardened steel with a rough surface texture.

The second clamping cylinder 118 of the breakaway unit 79 is identical to the first one.

At the point of contact with the clamping jaws of the clamping cylinders 116 and 118, the drill rods have a matching surface contour in the form of circumferential sections juxtaposed at an angle of about 120° relative to each other, assuring a positive grip when the drill rod is clamped.

The drill rod assembly 12 extends through a U-shaped opening 132 provided in the support 112 in mirror-symmetric fashion relative to the vertical center plane 114. The open end of the U may be closed by means of a bridge 134 screwed to the top of the support.

For its positional retention the support 112 is provided underneath the opening 132 with a routed slot 136 which in circular fashion extends around a center point on the axis 58 and is likewise mirror-symmetrical relative to the vertical center plane 114. Two pillow block bolts 140 and 142, mounted in a pedestal 138 that connects to the frame 48, extend through the slot 136 parallel to the axis 58 and hold the support 112 even when it swivels around the axis 58 of the drill rod assembly.

The rotation of the breakaway unit 79 is driven by a breakaway cylinder 144 whose piston 146 bears on the right wing of the support 112 to the side of the axis 58. For that purpose the forward end of the piston 146 is swivel-mounted on the support 112 by way of an articulated joint 148. A cantilever 150 screwed to the pedestal 138 holds the cylinder 144 on an articulated joint 152. By virtue of this arrangement the breakaway cylinder 144 cannot rotate under the pressure axially exerted on the piston 146 when the support 112 is pivoted.

To separate a screwed connection between the drive chuck 57 and a drill rod, the clamping jaws 102 and 106 of the clamping unit of the transport arm 66 grasp the drive chuck 57 and the clamping jaws 126 of the breakaway unit 79 grasp the drill rod. The breakaway cylinder 144 is then actuated and the drill rod is swiveled with the breakaway unit 79 by about 40° against the drilling direction of rotation of the drill rod, while the drive chuck 57 is held stationary.

What is claimed is:

1. An earth borer system with a frame (48) attached to which in movable fashion is a rotary drive (50, 54, 56, 57) for a drill rod assembly (12) of at least two drill rods which can be detachably connected with one another along a bore axis (58);

with a drill rod magazine (44) attached to the said frame (48);

with a release mechanism which is mounted on the frame (48) and incorporates a clamping unit (102, 104, 106, 108, 110) releasably rotationally fixable relative to a first drill rod and a breakaway unit (79) releasably rotationally fixable relative to a second drill rod; and with at least one transport arm (66, 68) which is mounted on the frame (48) and which can move a drill rod separated from the drill rod assembly (12) into a standby position in the drill rod magazine (44) or take a drill rod (78) from its stored standby position and set it against the drill rod assembly (12); characterized in that at least one unit of the release mechanism is mounted on the transport arm (66, 680, and by a drive means (114) separate from the rotary drive for the drill rod assembly (12) for rotating the clamping unit and breakaway unit relative to one another to break a threaded connection between the first drill rod and the second drill rod.

2. An earth borer system as in claim 1, further characterized in that the breakaway unit (79) is mounted on the transport arm (66, 68).

3. An earth borer system as in claim 1, further characterized in that the clamping unit (102, 104, 106, 108, 110) is mounted on the transport arm (66, 68).

4. An earth borer system as in claim 1, further characterized in that the transport arm (66, 68) is mounted on a pivot (67, 69) extending parallel to the bore axis (58) underneath the drill rod magazine (44) and is connected with a drive mechanism (98, 100), and in that said at least one unit of the release mechanism is mounted at one end of the transport arm (66, 68).

5. An earth borer system as in claim 4, further characterized in that the transport arm (66, 68) is formed essentially as a disc extending in a direction perpendicular to its pivot axis of rotation (67, 69), and having the contour of a section of an ellipse with two intersecting straight sides and one curved side, and in that the pivot axis (67, 69) is positioned approximately at the point of intersection of the two sides of the ellipse section.

6. An earth borer system as in claim 3, further characterized in that the clamping unit (102, 104, 106, 108, 110) is equipped with two clamping jaws (102, 106) at least one of which can be moved relative to the other.

7. An earth borer system as in claim 6, further characterized in that at least one of the clamping jaws (102, 106) can pivot around an axis (104) on the transport arm (66).

8. An earth borer system as in claim 6, further characterized by a hydraulic drive mechanism (108, 110) mounted on the transport arm (66) and serving to drive the movable clamping jaw (106).

9. An earth borer system as in claim 1, further characterized in that the clamping unit (102, 104, 106, 108, 110) is provided with elements for a positive, matching fit with a corresponding drill rod.

10. An earth borer system as in claim 1, further characterized in that the clamping unit (102, 104, 106, 108, 110) has clamping jaws equipped with interchangeable clamping inserts (128, 130).

11. An earth borer system as in claim 10, further characterized in that the clamping inserts (128, 130) are made of hardened steel and have a rough surface texture.

12. An earth borer system as in claim 1, further characterized by at least two transport arms (66, 68) one of which is provided with the clamping unit (102, 104, 106, 108, 110) or with the breakaway unit (79).

13. An earth borer system as in claim 2, further characterized in that the breakaway unit (79) incorporates a clamping device (126) which is pivotable around the bore axis (58).

14. An earth borer system as in claim 1, further characterized in that the drill rod magazine (44) contains at least two drill rod compartments (90, 92, 94, 96) in a side-by-side arrangement approximately perpendicular to the bore axis (58).

15. An earth borer system as in claim 1, further characterized in that the drill rod magazine (44) contains an S-shaped drill-rod compartment.

* * * * *